US006288651B1

(12) United States Patent
Souza

(10) Patent No.: US 6,288,651 B1
(45) Date of Patent: Sep. 11, 2001

(54) PORTABLE ROADWAY PERIMETER ALARM

(76) Inventor: William Souza, 40249 Castana La., Palmdale, CA (US) 93551

( * ) Notice: Subject to any disclaimer, the term of this patent is extended or adjusted under 35 U.S.C. 154(b) by 0 days.

(21) Appl. No.: 09/391,029

(22) Filed: Sep. 7, 1999

Related U.S. Application Data

(63) Continuation-in-part of application No. 08/885,504, filed on Jun. 30, 1997, now abandoned.

(51) Int. Cl.[7] ..... G08G 1/01

(52) U.S. Cl. ..... 340/933; 340/908; 340/908.1; 340/940; 340/666; 200/86 A

(58) Field of Search ..... 340/540, 541, 340/544, 908, 908.1, 933, 940, 665, 666; 200/85 R, 86 A

(56) References Cited

U.S. PATENT DOCUMENTS 5,265,556 * 11/1993 Hall ..... 116/63 P
5,294,924 * 3/1994 Dydzyk ..... 340/908.1
5,457,449 * 10/1995 Kuning et al. ..... 340/908
5,661,474 * 8/1997 Douglas ..... 340/940
5,760,686 * 6/1998 Toman ..... 340/540

* cited by examiner

*Primary Examiner*—Edward Lefkowitz
(74) *Attorney, Agent, or Firm*—Dennis W. Beech

(57) ABSTRACT

The portable roadway perimeter alarm has an impact sensor which may be a shock or pressure sensor that is connected to a transmitter. The impact sensor and transmitter unit is located around the perimeter of a roadway work area to detect vehicles penetrating the perimeter into the designated work area which vehicles may represent a hazard to work crews. The vehicle penetration event is transmitted to a warning receiver and alarm unit which may be placed in a pocket of a worker's vest or may be mounted on a work vehicle to sound an area alarm. The impact sensor and transmitter units are durable and operate in adverse environmental conditions.

11 Claims, 6 Drawing Sheets

PORTABLE ROADWAY PERIMETER ALARM

This application is a continuation-in-part of U.S. patent application Ser. No. 08/885,504, filed Jun. 30, 1997, now abandoned.

BACKGROUND OF THE INVENTION

1. Field of the Invention

This invention relates to apparatus used to warn persons that an object has penetrated a perimeter sensor system. The improved warning system uses impact or pressure sensors to detect perimeter penetration and transmits this event to an alarm device located in the vicinity of or on the persons to be warned.

2. Description of Related Art

There are currently various methods and apparatus used to designate and protect areas in which roadway work personal are performing their tasks. These include the well known safety cone which is usually bright orange and may include reflective material. Lighting for night work is also incorporated in safety cones. Other apparatus include vehicles which have flashing arrow pointers to indicate a lane in the roadway is closed are also used. The traditional static signs warning of roadwork are commonly used. Even vehicles are placed in front of approaching traffic to act as safety barriers for errant vehicles to attempt to protect the workers.

More complex systems have also been proposed for use to warn roadway workers of moving vehicles which may pose a danger to them in their work environment. These concepts include those represented in U.S. Pat. Nos. 4,998,093, 5,265,556, 5,661,474 and 5,128,670. Additional disclosures and apparatus are also described in U.S. Pat. No. 4,998,093.

Most of the apparatus proposed for detecting vehicle movement in a sensor monitoring situation use a light beam detection system. Such systems essentially use a light source and a light detector to establish a detection system. If an object, such as a vehicle, interrupts the light beam path to the light detector an alarm activation mechanism is initiated to sound an alarm signal or otherwise give notice to persons that a vehicle has penetrated the designated area.

In U.S. Pat. No. 4,998,093 the alarm receiver is located with a person and includes an earphone so the individual will hear the alarm even in high ambient noise conditions such as on high traffic highways. For this alarm device the receiver normally receives a signal under no danger conditions and when the signal is interrupted when an object interrupts the light beam sensor an alarm is initiated. Also, if a system problem occurs to interrupt the signal to the receiver an alarm is sounded.

While many systems rely on optical light sensors to detect vehicles, some disclosures include the use of object motion detectors which are not defined in detail, but would involve some ranging technique such as a radar like unit. All of these systems, including the light beam sensor based systems, suffer from the problem of complexity in installation of the system at the work site. The systems must be properly installed to assure the integrity of the light path or motion detector field of view. For irregular road areas or unusual environmental conditions the sensors may be difficult or impossible to locate in the proper area.

An impact type device for traffic safety warning is disclosed in U.S. Pat. No. 5,265,556. However, the device is not a safety cone and is not compatible with safety cone use by road crews as is commonly done, i.e., it is not stackable, easily handled and the like use.

The present invention uses sensor elements which are much easier for the road workers to deploy to define the perimeter of the work area. The commonly used safety cone is fitted with an impact sensor and transmitter. This allows the user to use roadway warning safety cones in the normal manner to define the work area and notify drivers of the road work and its perimeter boundary. A pressure sensor tube may be used in combination with the safety cone or independently to provide warning of a vehicle penetration of the perimeter of the work area. These sensors have the advantage of ease of installation and reduced susceptibility to adverse environments as compared to light beam sensors and motion detectors which can be impacted by foul weather as an example.

While the use of a pressure sensitive air hose was disclosed in U.S. Pat. No. 4,998,093, it was discarded as being unworkable. U.S. Pat. No. 5,661,474 does disclose a hose sensor for pressure such as an automobile tire passing over the device. However, the invention does not allow storing all the elements on a reel, i.e., the junction boxes between hose lengths. This creates a cumbersome system. Contrary to this characterization, a properly constructed pressure tube or hose system can provide a work area perimeter sensor to detect vehicle intrusion. Again, these impact or pressure sensor elements combined with a means to transmit an event to an alarm element provide an improved system for ease of installation and use in rugged environments.

SUMMARY OF THE INVENTION

A primary objective of the present invention is to provide an alarm system for roadway workers which detects intrusion by a vehicle through a perimeter defined area to warn workers of possible danger. A further object is to provide the sensor element of the alarm system in an easy to install configuration. Another object is to have a system which operates in adverse environments. An additional object is to provide portability and use of a transmitter and receiver for flexibility in sensor and alarm location.

In accordance with the description presented herein, other objectives of this invention will become apparent when the description and drawings are reviewed.

DESCRIPTION OF THE PREFERRED EMBODIMENT

The portable roadway perimeter alarm is an impact sensor detection system which activates an alarm to warn roadway workers that a vehicle has penetrated an established safety perimeter. The impact sensor can be a shock detector or a pressure change detector. The impact sensor is connected to a transmitter which may use radio waves or wire to transmit the occurrence of a vehicle contact. The occurrence of the event is received and converted to sound an alarm to the road workers. In the case of the use of radio wave transmission the receiver and alarm element may be carried by individual road workers.

Figure 1:
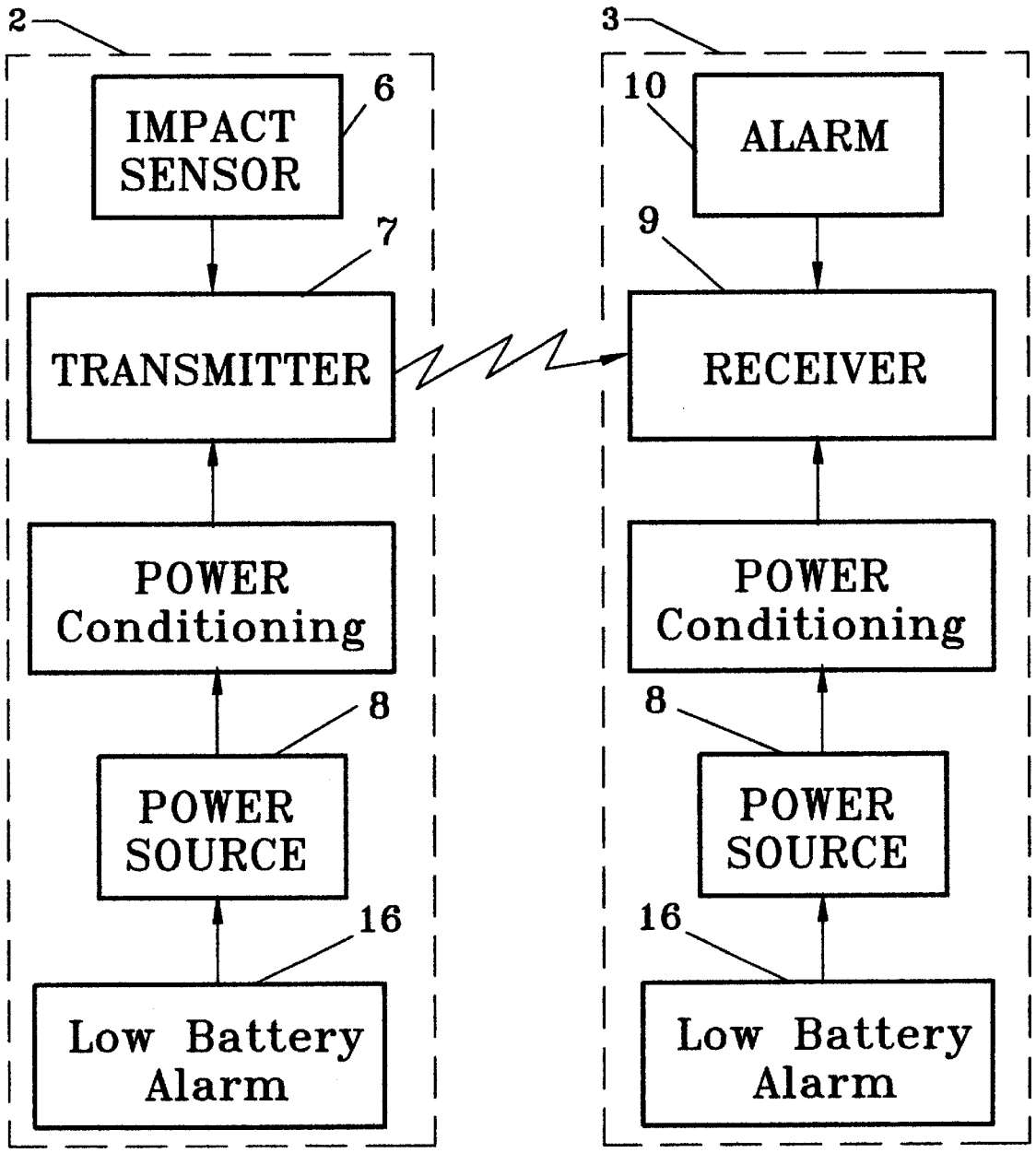
FIG. 1 illustrates a block diagram of the perimeter alarm system with a transmitter and receiver.
Figure 2:
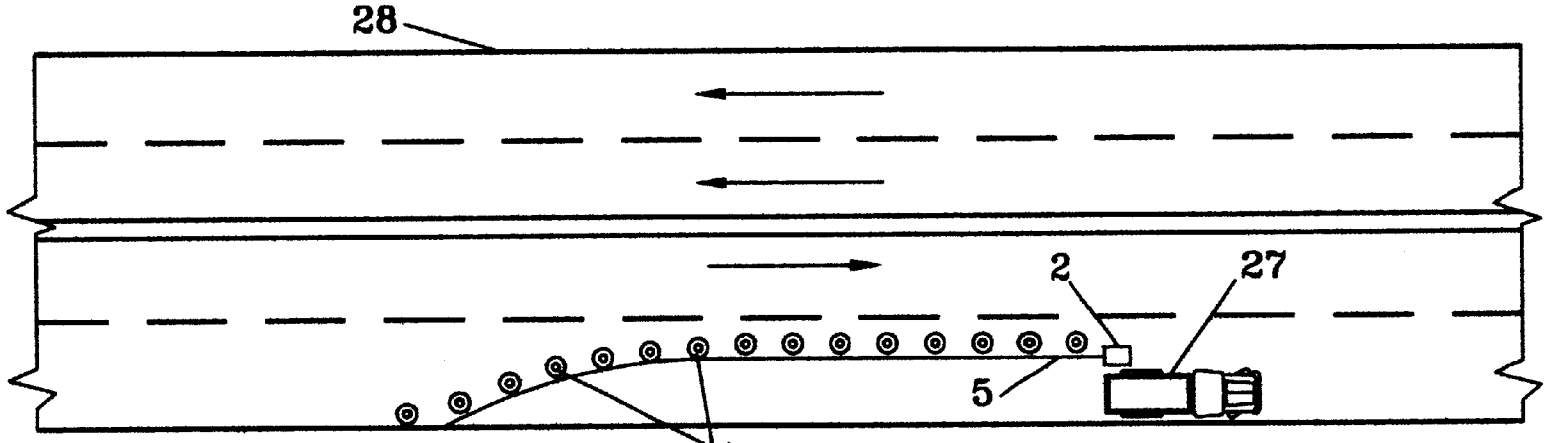
FIG. 2 illustrates a representative deployment of safety cones and road tube sensors for the perimeter alarm system on a roadway.
Figure 3:
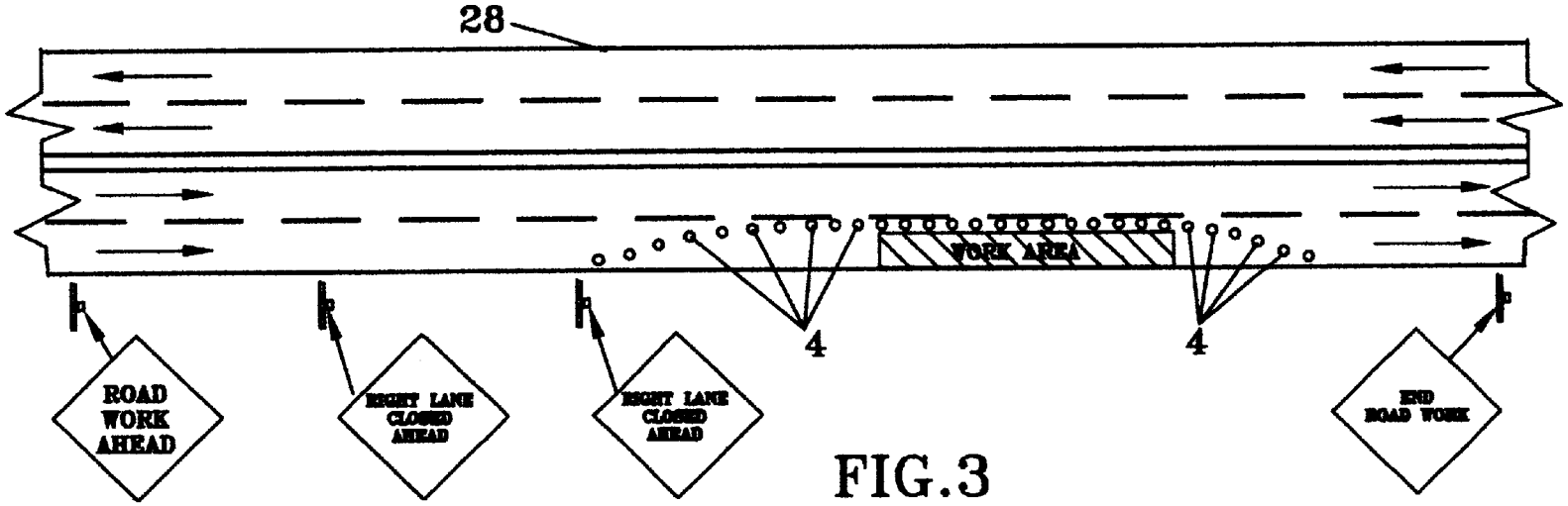
FIG. 3 illustrates an extensive deployment of safety cone sensors on a roadway to provide a warning perimeter for workers on a roadway.
Figure 4:
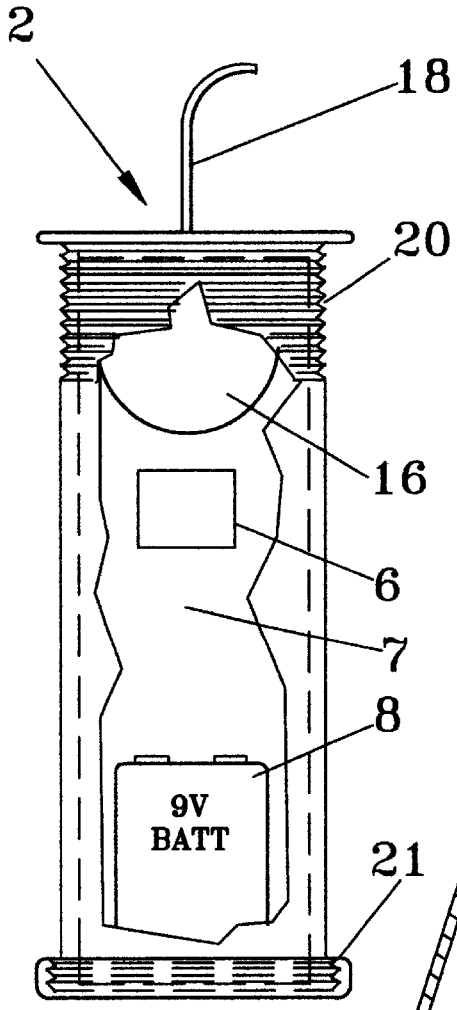
FIG. 4 illustrates an impact sensor and transmitter.
Figure 5:
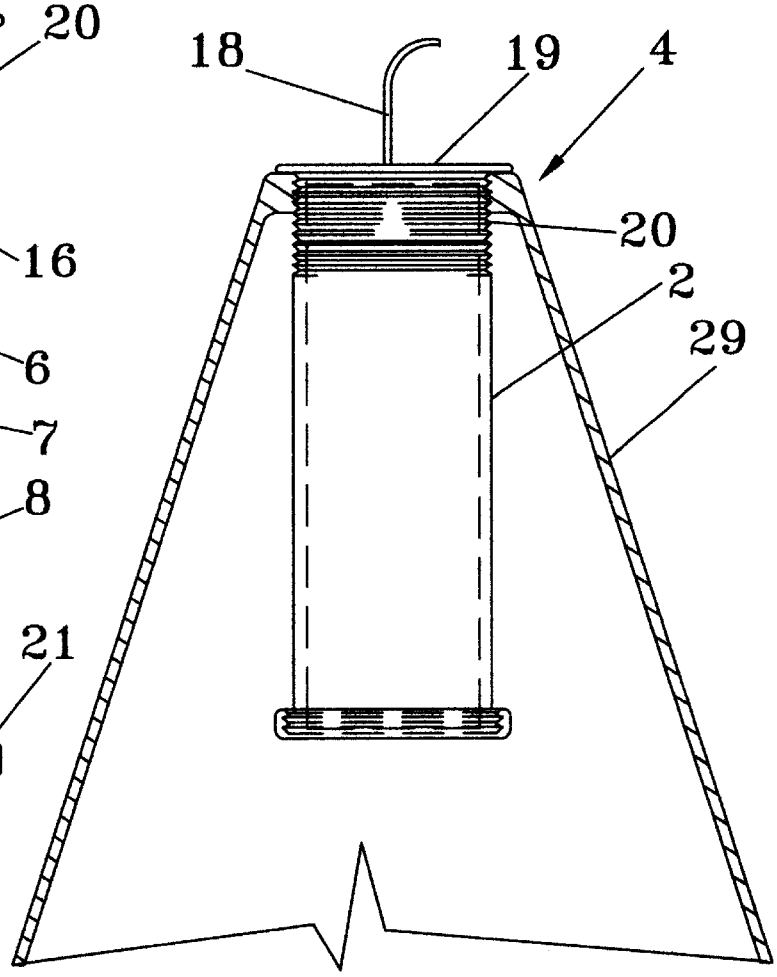
FIG. 5 illustrates the impact sensor and transmitter installed in a safety cone.

Referring to FIG. 1, the portable roadway perimeter alarm (1) has an impact sensor and transmitter unit (2) and a warning receiver and alarm unit (3). When the impact sensor and transmitter units (2) are deployed as illustrated in FIGS. 2 and 3, a vehicle which could be a threat to the workers by crossing the defined perimeter would contact the safety cones (4) or road tube (5). The safety cone (4) with impact sensor and transmitter unit (2) installed can be located on the roadway (28) in the conventional manner by the road work crew. This allows for a wide variety in definition of a safety perimeter in all types of roadway configurations. The road tube (5) with impact sensor and transmitter (2) is more limited as it is a continues line which must be located on the roadway (28).

Referring to FIGS. 4 through 8, the impact sensor and transmitter unit (2) for the safety cone (4) has a shock sensor (6) connected to a transmitter (7). The shock sensor (6) detects an impact as for example a 4 g motion caused by a moving vehicle hitting the safety cone (4) at 10 miles per hour. The impact sense conditions may be adjusted for the environment and to allow handling by humans or machines for safety cone (4) placement as for example a 10 g force for a vehicle traveling at 25 mph. The impact sensing may also have a non-activation made for use during handling to avoid sensing or false alarms. The force of the impact is converted to a signal to the transmitter (7) to transmit the occurrence of the event through the antenna (18) by electromagnetic wave. A battery (8) is used to power the unit (2). A cylindrical shaped impact sensor and transmitter unit (2) with height 4.25 inches and diameter 1.25 inches has been found practical to fit in the top (19) of a safety cone (4). The safety cone (4) may be fitted with a threaded insert into which the sensor and transmitter unit (2) may then be mounted by means of threads (20). These dimensions are adequate for containing the transmitter (7) circuit board as well as the shock sensor (6), low battery alarm (16) and battery (8) with associated wiring. The impact sensor and transmitter unit (2) enclosure should be constructed of high impact resistant material such as a polycarbonate plastic, such as currently known tradename LEXAN, and have provision for battery (8) replacement such as end cap (21). The enclosure may be filled with a 2 pound density polyurethane for further protection.

Figure 8:
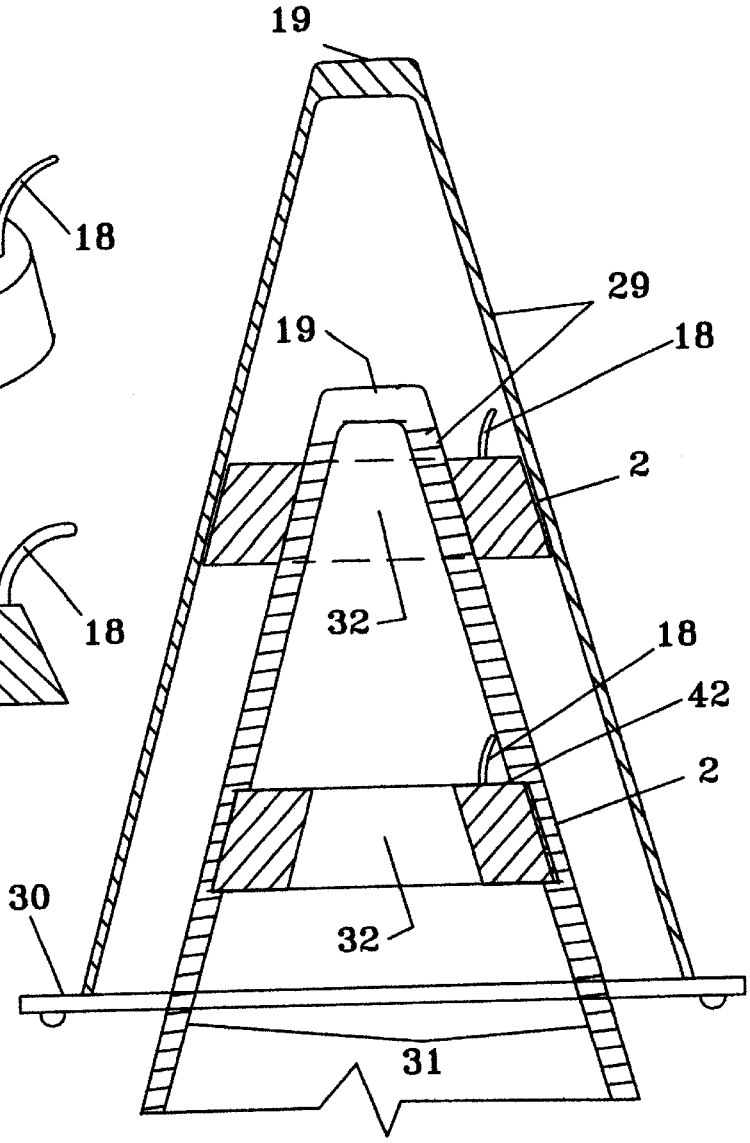
FIG. 8 illustrates alternate locations of the impact sensor and transmitter in the safety cone.
Figure 9:
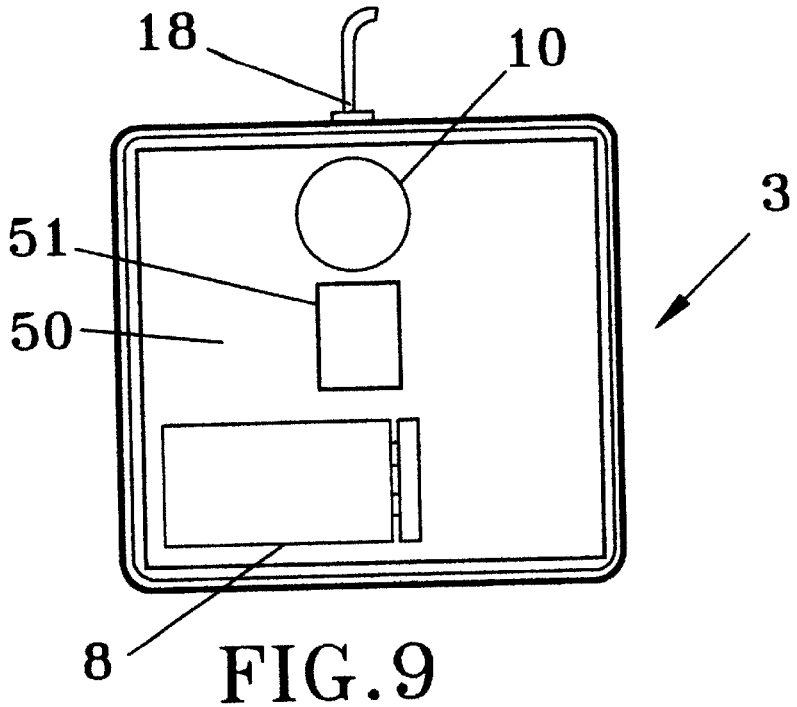
FIG. 9 illustrates a portable receiver and alarm for individual carry.

In an alternate configuration, the impact sensor and transmitter unit (2) is also fabricated of a high impact polycarbonate plastic material in a truncated cone shape to accommodate mounting the unit (2) inside a standard safety cone (4), intermediate the top (19) and bottom (30). There may also be an aperture (32) formed radially about the center of the unit (2) to allow for manual or automatic stacking and unstacking of safety cones (4). The unit (2) would normally be attached to the safety cone (4) by an adhesive or bounding compound although fasteners may also be used. Such attachment means would include characteristics to withstand high impact forces to inhibit the unit (2) from separating from the safety cone (4). The unit (2) may also be molded in the wall of the safety cone (4) as illustrated in FIG. 8 at (42). Other form factor units (2) may be used as for example cylindrical with a central aperture to be mounted in safety markers which are generally tall cylindrical shape used on roadways.

It has been found that an impact sensor and transmitter unit (2) weight of approximately 5.4 ounces including batter may be achieved. The unit is filled with approximately 2 pounds of a dense foam to resist high impact damage.

Referring to FIGS. 9 through 13, the transmitted event is received by one or more receivers (9) in warning receiver and alarm units (3). The signal is conditioned to activate an alarm (10) such as a buzzer or siren and vibrator (51). The warning receiver and alarm unit (3) may be mounted in a pocket (11) of a vest (12) to be worn by a road worker. This provides the alarm sound close to the worker for ease of hearing under high background noise conditions and vibration will be apparent.

Figure 6:
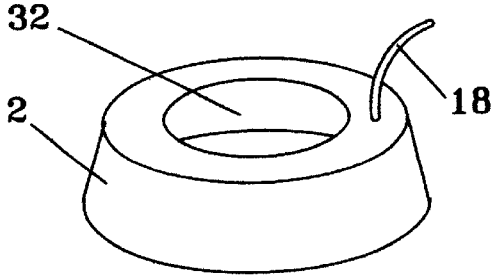
FIG. 6 illustrates a perspective view of the truncated cone impact sensor and transmitter.
Figure 7:
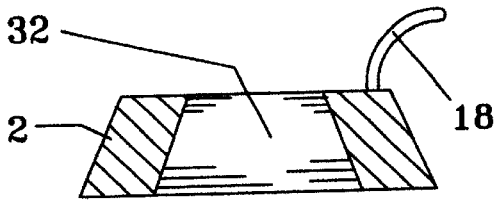
FIG. 7 illustrates a cross sectional view of the truncated cone impact sensor and transmitter.

The impact sensor and transmitter unit (2) normally has the functions of shock sensor, RF modulation and radiation, low battery detect, and battery power and conditioning. The warning receiver and alarm unit (3) normally has the functions of RF reception, alarm and vibration warning, low battery detect when on battery power, and power supply and conditioning. As illustrated in FIG. 6, the warning receiver and alarm unit (3) contains a printed circuit board (28) for the transmitter (9) and other electronic functions with a battery (8), alarm (10) and vibrator (51) connected and having an antenna (18) for receiving the transmitted signal. A warning receiver and alarm unit (3) enclosure having dimensions of height 3.8, width 2.4 and depth 1.00 inch has been found suitable for use in a vest (12) which has a pocket (11) located at the height of the shoulder blades of a user. Such a location is useful in high noise environments for purposes of hearing the alarm (10) and detecting the vibrator (51).

This portable unit (3) would normally have a 9 volt battery (8) and provide logic to operate in a low power standby-to-receive mode to conserve battery life until a signal is received to activate the alarm (10) and vibrator (51). The alarm (10) and vibrator (51) would then sound and vibrate for example for 10 seconds and then reset to standby to conserve power. Likewise the impact sensor and transmitter unit (2) would only transmit for example for 3 seconds and then reset to standby mode until impacted by an object. With proper circuitry and transmit-receive functions the time to alarm after impact can be as short as 50 milliseconds using currently available components.

Figure 10:
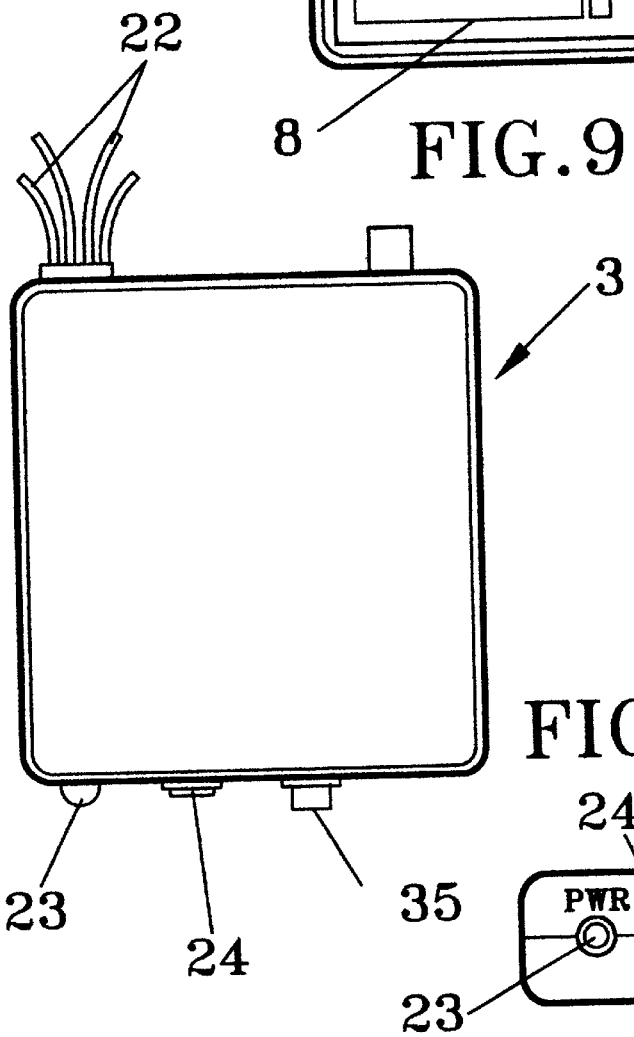
FIG. 10 illustrates the plan view of an enclosure for a vehicle or similar mount warning receiver and alarm unit.
Figure 11:
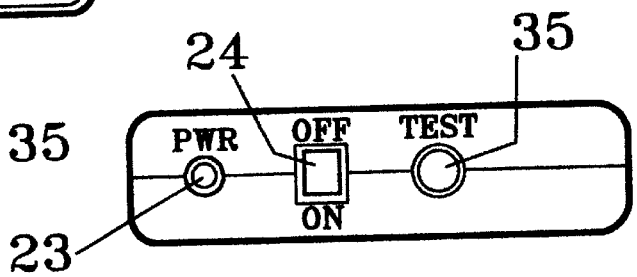
FIG. 11 illustrates an end view of the vehicle unit.
Figure 12:
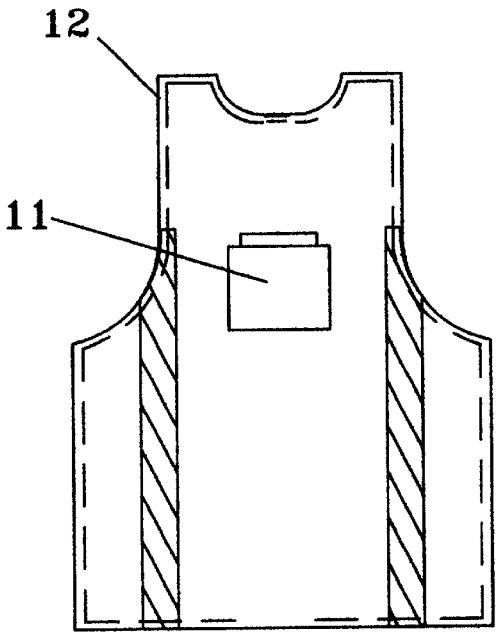
FIG. 12 illustrates the back of a worker's vest with a portable warning receiver and alarm unit installed.
Figure 13:
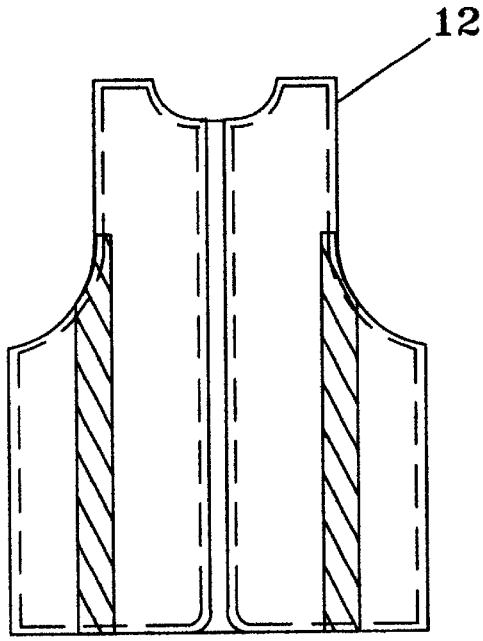
FIG. 13 illustrates a front view of the worker's vest.

Referring to FIGS. 10 and 11, the warning receiver and alarm unit (3) may also be mounted on a vehicle or work truck (27) in the work area. In this configuration the unit (3) could be powered by the 12 volt system of the vehicle and be connected to a siren or other alarm (10) device using connections (22). A power indicator (23), an on/off switch (24) and a test button (35) may be provided.

Figure 14:
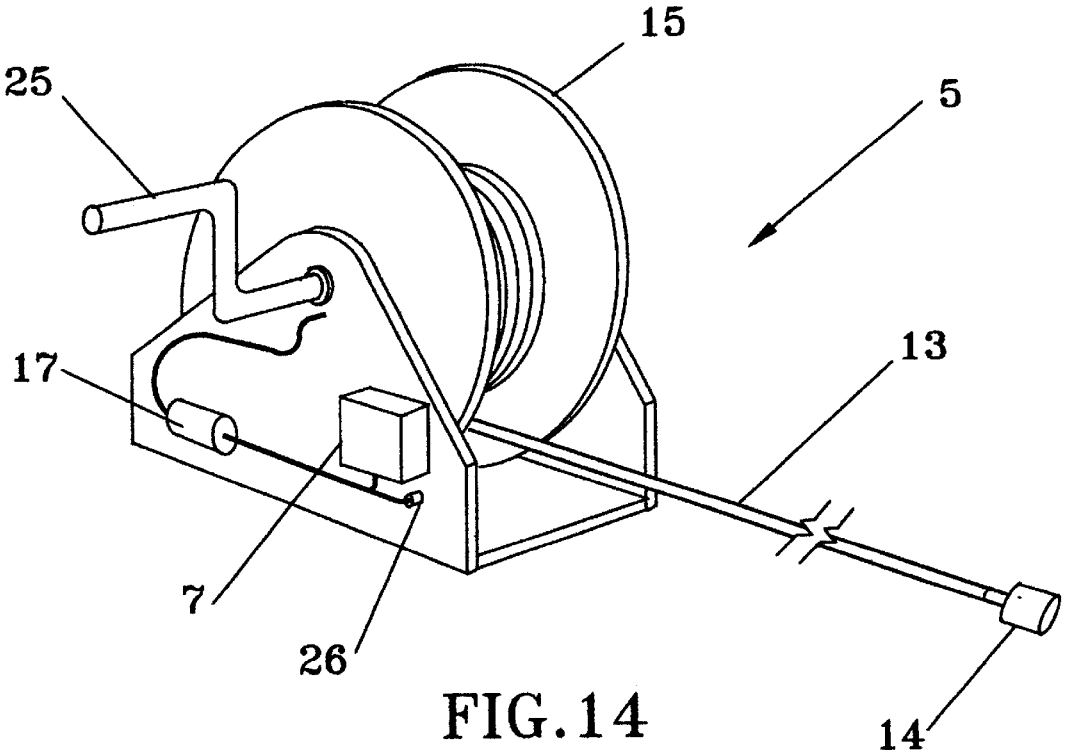
FIG. 14 illustrates a road tube pressure sensor and reel.

Referring to FIG. 14, the impact sensor and transmitter (2) in an alternate embodiment has a road tube (5) comprised of a biodegradable fluid filled hose (13) with cap (14). The hose

(13) is used in conjunction with a reel (15) from which it may be unwound for deployment on a roadway (28) and on which it may be stored when not in use. A handle (25) or electric motor (not shown) may be used to operate the reel (15). The hose (13) is connected to a pressure sensor (17) in the conventional manner. When a vehicle impacts the road tube (5) by for example the wheels crossing over the hose (13), the pressure is changed in the hose (13) and sensed by the pressure sensor (17). The pressure sensor (17) is electrically connect to the transmitter (7) which transmits a signal to the receiver (9) for activation of alarm (10). Alternatively the impact sensor and transmitter unit (2) may transmit directly to the work truck (27) power and to the warning receiver and alarm unit (3) by vehicle connector (26) when the unit (2) is located with the work truck (27).

In an alternate embodiment the hose (13) may be of the electric ribbon switch type wherein two lead wires are contained in an environmental resistant ribbon sheath or hose (13) of desired length having an electrical connection to transmitter (7) and vehicle connector (26). In this embodiment when a vehicle impacts the road tube (5) the pressure causes the lead wires to signal the event for transmission as for example by means of transmitter (7). Electrical ribbon switch devices are available as for example Sensing Switches sold by TAPE SWITCH CORPORATION.

In the instance of use of fluid for hose (13), an inside diameter of approximately ¼ inch and outside diameter of approximately ⅜ inch constructed of a hard dyrometer, approximately 60, flexible material provides a configuration that may be reasonably handled on the reel (15). This overcomes the prior problems of bulky hoses (13) yet provides a durable system for the road work environment. The hose (13) may also be contained in a nylon sleeve if extreme environmental conditions are encountered. Fluids such as liquid, air and the like may be used in the hose (13) depending on length and sensor system characteristics. The required length of a hose (13) may vary based on governmental requirements as for example a minimum length of 1000 feet would be required for California highways.

I claim:

1. An apparatus for detecting a vehicle penetrating a perimeter of a roadway work area and providing a warning to workers in the work area comprising:

an impact sensor and transmitter unit having an electromechanical shock sensor electrically connected to a transmitter;

the impact sensor and transmitter unit having a means for communication with a warning receiver and alarm unit;

the impact sensor and transmitter unit mounted in a top of a safety cone; and a means for providing electrical energy to the impact sensor and transmitter unit.

2. The apparatus as in claim 1 wherein the apparatus is additionally comprised of a road tube having a hose filled with a fluid which hose is connected to a pressure sensor electrically connected to a second transmitter having a communication means with the warning receiver and alarm unit and an end cap closure at a hose opposite end from the pressure sensor.

3. The apparatus as in claim 1 wherein the warning receiver and alarm unit is comprised of a receiver and an alarm in an enclosure which may be carried in a vest having a pocket defined therein for wear by a person to be warned; and the alarm including a vibrator.

4. The apparatus as in claim 1 wherein the apparatus is additionally comprised of a road tube having a hose containing a plurality of lead wires with a means for sensing pressure applied to the road tube and with the lead wires electrically connected to a second transmitter having a communication means with the warning receiver and alarm unit.

5. An apparatus for detecting a vehicle penetrating a perimeter of a roadway work area and providing a warning to workers in the work area comprising:

an impact sensor and transmitter unit having a road tube with a hose filled with a liquid which hose is connected to a pressure sensor at an end and an end cap closure at a hose opposite end from the pressure sensor;

the pressure sensor electrically connected to a transmitter having a communication means with a warning receiver and alarm unit; and a means for providing electrical energy to the impact sensor and transmitter unit.

6. An apparatus for detecting a vehicle penetrating a perimeter of a roadway work area and providing a warning to workers in the work area comprising:

an impact sensor and transmitter unit having an electromechanical shock sensor electrically connected to a transmitter;

the impact sensor and transmitter unit having a means for communication with a warning receiver and alarm unit;

the impact sensor and transmitter unit mounted intermediate a top and a bottom of a safety cone; and a means for providing electrical energy to the impact sensor and transmitter unit.

7. The apparatus as in claim 6 wherein the impact sensor and transmitter unit is shaped as a truncated cone and is sized to be attached to the interior wall of the safety cone.

8. The apparatus as in claim 7 wherein the impact sensor and transmitter unit having a center aperture defined therein.

9. The apparatus as in claim 6 wherein the impact sensor and transmitter unit is shaped as a truncated cone having an aperture defined therein and is sized to be molded as part of the wall of a safety cone.

10. The apparatus as in claim 6 wherein the impact sensor and transmitter unit is shaped as a cylinder having a center aperture defined therein.

11. The apparatus as in claim 6 wherein the apparatus is additionally comprised of a road tube having a hose containing a plurality of lead wires with a means for sensing pressure applied to the road tube and with the lead wires electrically connected to a second transmitter having a communication means with the warning receiver and alarm unit.

* * * * *